US006058569A

United States Patent [19]

Vezzoli et al.

[11] Patent Number: 6,058,569

[45] Date of Patent: May 9, 2000

[54] UNIT FOR OPENING AND SEPARATION OF THE IMPURITIES, FOR MACHINES FOR OPENING OR CARDING OF FLOCK TEXTILE MATERIAL

[75] Inventors: Emilio Vezzoli; Giovanni Battista Pasini, both of Palazzolo Sull'Oglio, Italy

[73] Assignee: Marzoli S.p.A., Palazzolo Sull'Oglio, Italy

[21] Appl. No.: 09/295,601

[22] Filed: Apr. 22, 1999

[30] Foreign Application Priority Data

Apr. 24, 1998 [IT] Italy ..... MI98A0881

[51] Int. Cl.[7] ..... D01B 3/00

[52] U.S. Cl. ..... 19/205; 19/98; 19/105

[58] Field of Search ..... 19/98, 99, 105, 19/106 R, 107, 104, 108, 110, 113, 200, 202, 203, 204, 205

[56] References Cited

U.S. PATENT DOCUMENTS

| | | | |
|---|---|---|---|
| 4,505,005 | 3/1985 | Staehli | 19/200 |
| 5,546,635 | 8/1996 | Leifeld | 19/200 |
| 5,697,126 | 12/1997 | Baker, Jr. | 19/200 |

*Primary Examiner*—Michael A Neas
*Assistant Examiner*—Gary L. Welch
*Attorney, Agent, or Firm*—Oblon, Spivak, McClelland, Maier & Neustadt, P.C.

[57] ABSTRACT

Unit for opening and separation of the impurities, for machines for opening or carding of flock textile material, comprising separator blades for the removal of the impurities, consisting of a triangular cutting blade, which is mounted on the support with its inner surface disposed according to a small angle, relative to the tangent to the surface of the covering, and with the vertex disposed downstream from the motion of the cylinder.

6 Claims, 3 Drawing Sheets

PRIOR ART Fig.1A

UNIT FOR OPENING AND SEPARATION OF THE IMPURITIES, FOR MACHINES FOR OPENING OR CARDING OF FLOCK TEXTILE MATERIAL

The present invention relates to the opening and carding of fibrous flock material, for example cotton or other textile fibres, in which the material is processed on the surface of a series of covered rollers, which are provided with a multitude of spikes, or needles, or sawteeth, with various shapes and dimensions, blades and fixed carding elements, which are driven by motion relative to one another, in which the flock fibrous material is opened into the form of finer and cleaner flock, with elimination of a substantial part of the impurities contained in the fibres, which flock is to be forwarded to the successive processing stages, until the strip of fibres to be sent for spinning is obtained.

In order to make apparent the characteristics and advantages of the present invention, it is described by way of non-limiting illustration, with reference to its application to a horizontal opener. In fact, the present invention can also be applied to different machines for preparation of the fibres for spinning, in which there are required elements to separate the impurities from the fibres which are supported by the coverings in movement, by means of fixed blades, such as on the opening or crushing cylinders of flat carders.

In its most general outlines, the operation for opening of the flock in a horizontal opener takes place in the following main stages, illustrated with reference to FIG. 1, again with reference to the known art. Horizontal openers for flock fibres are described in U.S. patents U.S. Pat. Nos. 5,146,652, 5,255,415, 5,313,688 and 5,333,358.

Figure 1:
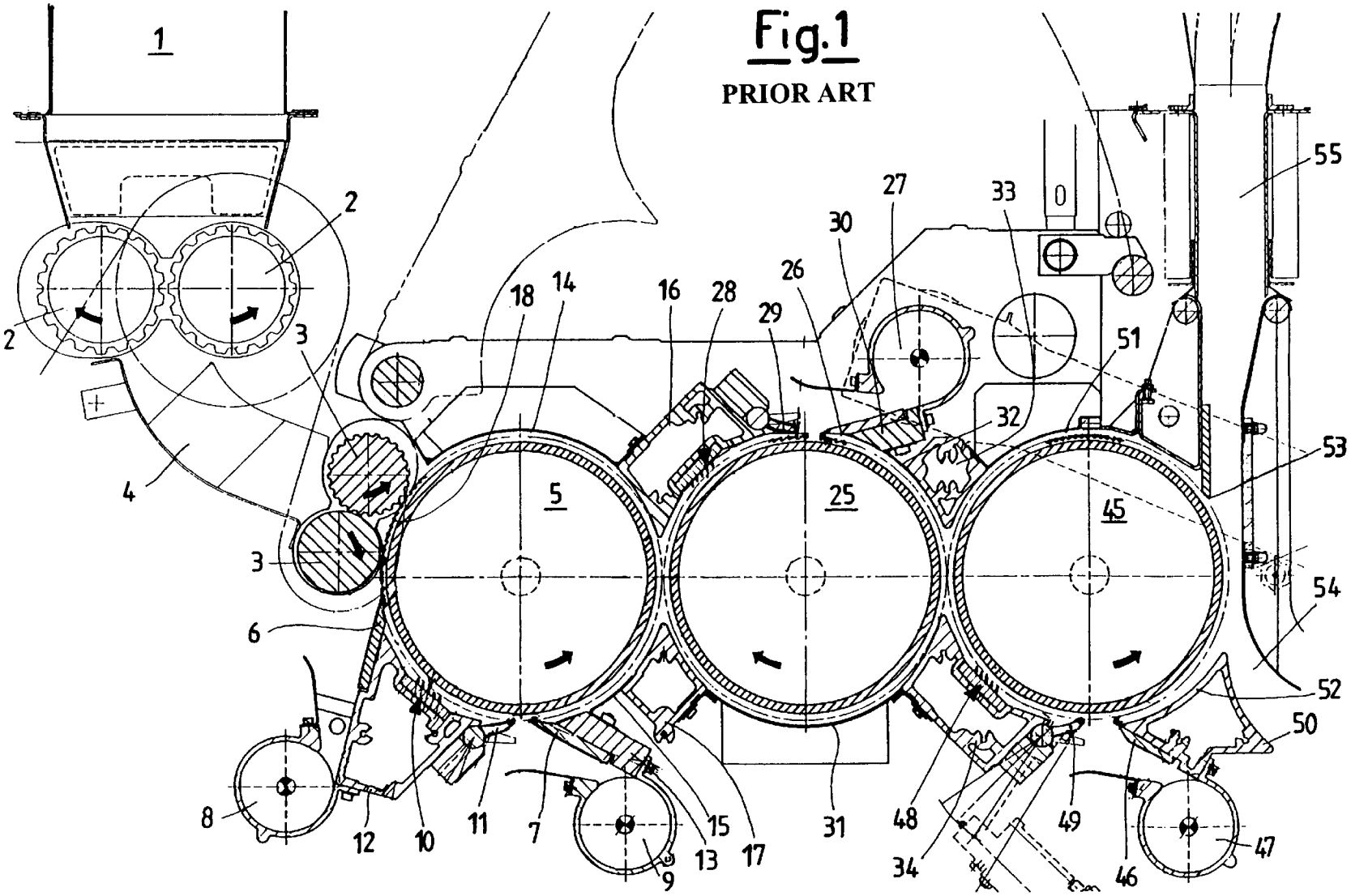
Fig.1 PRIOR ART

The untreated material, which consists of loose flock fibres, is distributed by a supply silo 1, and, by means of a pair of lobed conveyor cylinders 2 and a pair of gripper cylinders 3, which are connected to a duct 4, it is forwarded to a series of horizontal-axis opening cylinders 5,25,45, which are counter-rotated relative to one another. These opening cylinders are generally produced with diameters which are substantially the same as one another. FIG. 1 shows by way of example three cylinders in series, but there can be a greater number of cylinders.

Figure 2A:
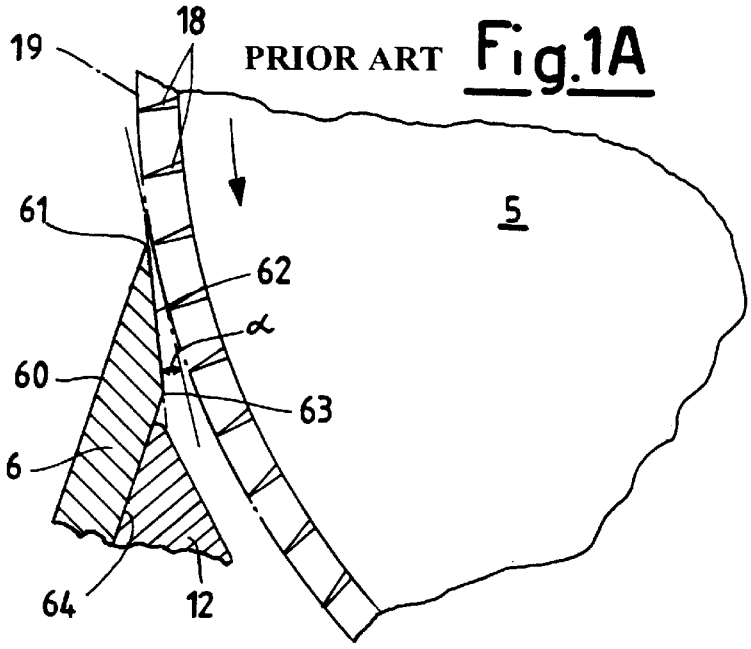
Figure 2A:
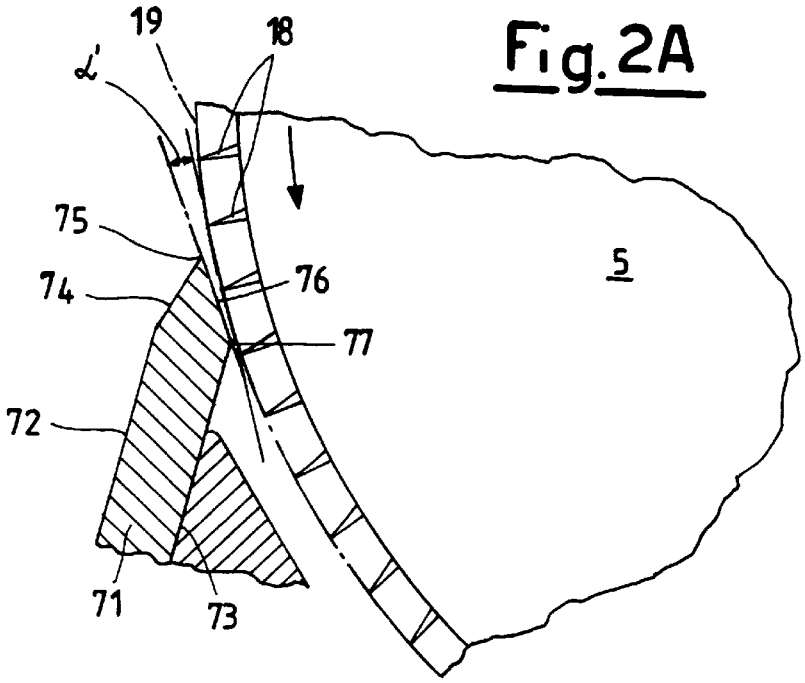
Figure 2:
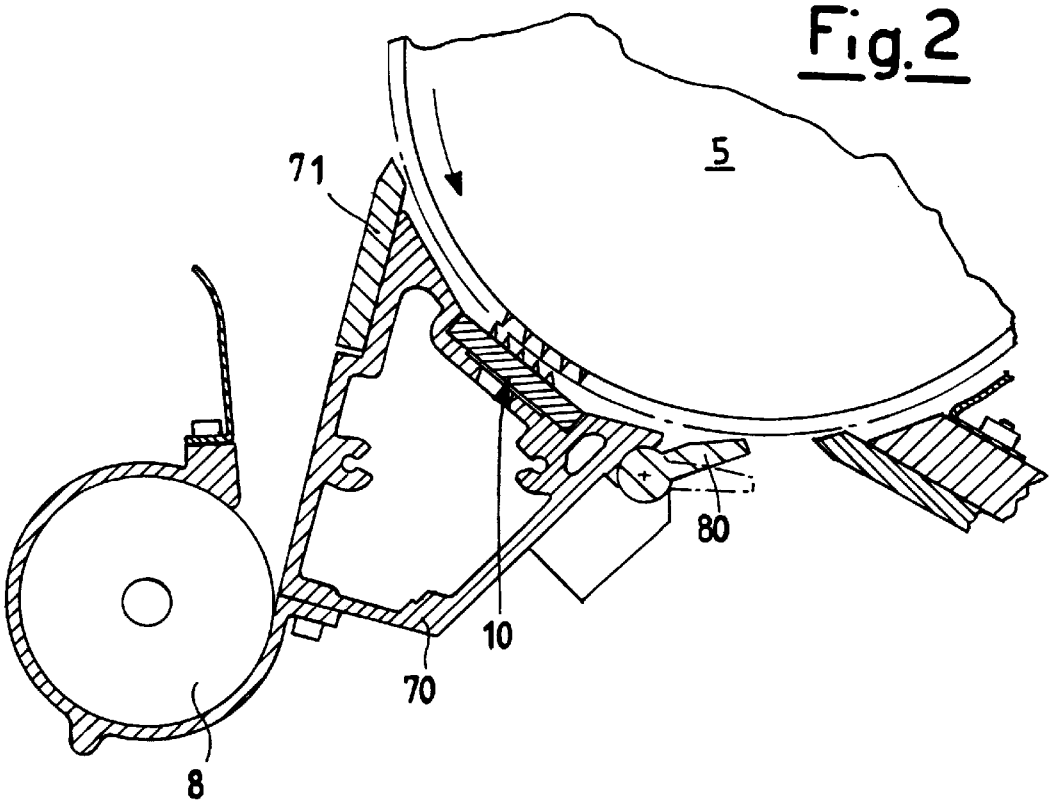
Figure 3:
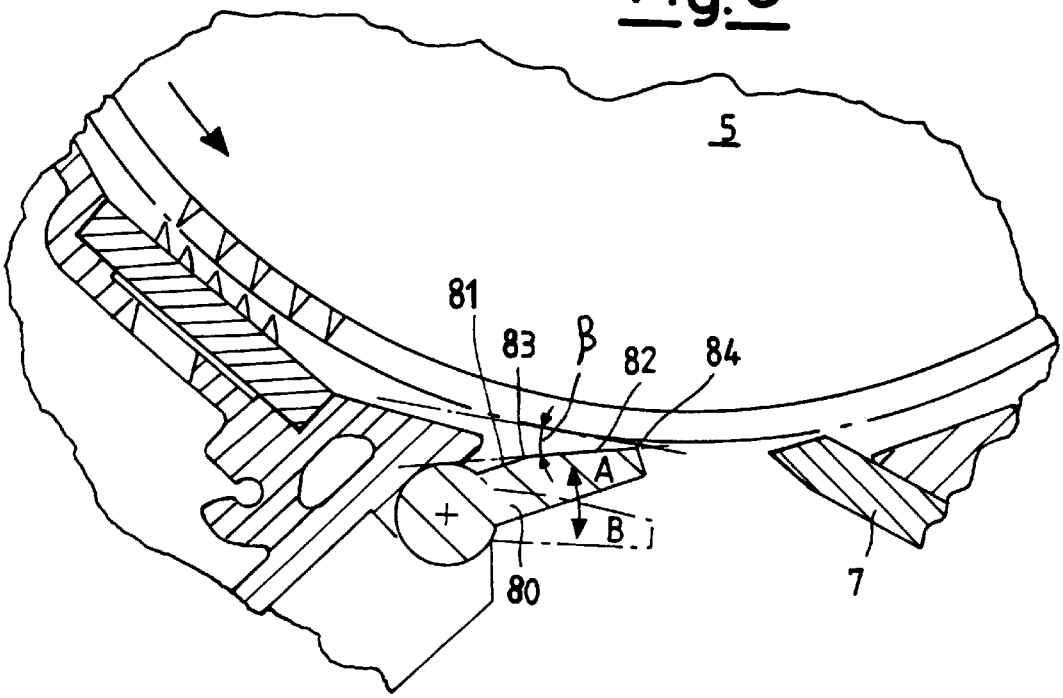

The first opening cylinder 5 rotates in an anti-clockwise direction. This cylinder is provided with a covering, consisting for example of needles or sawteeth, which receives the fibres, which, still in flock form, are disposed on the covered surface, and encounter a series of processing elements. These elements consist respectively of opening and separation units, comprising:

- separator blades 6,7, which are disposed in a free space of the cylindrical surface which surrounds the cylinder 5, in order to release impurities from the fibrous material, as shown in the enlarged detail in figure 1A;
- suction mouths 8,9, which collect the material detached by the blades 6,7 respectively, consisting of the impurities which are released from the fibrous material;
- one or a plurality of fixed carding segments 10, consisting of plates provided with spikes, shown in the enlarged details in FIGS. 2 and 3, which exert an action of stretching and opening of the tangles of fibres; and
- one or a plurality of mobile deflectors 11, to modify the opening of the free space for separation of the dirt to be removed by the blades.

These elements are mounted on bar supports 12,13, which extend in an axial direction relative to the cylinder 5. The said cylinder is also surrounded by container plates 14,15 and by connection wedges 16,17, which delimit the section of passage of the fibrous material, which is supported by the covered surface of the cylinder 5. These elements which surround the opening cylinders thus have apertures at their ends for release of the currents of air which are generated by ventilating effect, by the rotation of the rollers, and for positioning of the above-described opening and separation units, i.e. blades, mouths for suction of the waste and dirt separated, fixed carding plates, and deflectors. The two successive opening cylinders 25,45 are provided with similar elements for processing of the material, i.e. respectively:

- separator blades 26,46;
- suction mouths 27,47;
- fixed carding segments 28,48;
- mobile deflectors 29,49;
- bar supports 30,50;
- container plates 31,32,51; and
- connection wedges 33,34,52, which also act as supports for elements of the opening and separation units, which carry out the same functions as the similar elements described for the first cylinder 5.

At the end of the path on the third opening cylinder 45, the fibrous flock material is detached by a further doffer blade 53, assisted by a strong current of transport air, which is obtained from the duct 54, which is extended upwards with the duct 55, in which there is conveyed the smallest fibrous flock material, which is open and substantially free from most of the impurities. The procedure for processing the fibrous material in the opener takes place along the surfaces of the opener cylinders 5,25,45, which are disposed in series, and are provided with series of spikes, needles or sawteeth, which are progressively more dense, in order to carry out progressive stretching and cleaning of the tangles of fibres, thus obtaining cleaner flock fibres, removing bits of wood, seeds, shells, lumps and dust with varying degrees of fineness, as well as the short fibres. The material is passed from one cylinder to the next by the different and increasing speed at which the cylinders are actuated: in general the peripheral speeds of the cylinders are within the ranges of 10–25 m/sec. for the first cylinder, 20–35 m/sec. for the second cylinder, and 30–50 m/sec. for the third cylinder. These increasing speeds of the cylinders, in association with the container surfaces which are increasingly close to the rotary coverings, generate an energetic ventilating action on the layer of fibres supported on the coverings, as well as a strong centrifugal effect on the material, which is all the greater, the more dense and less filiform the material, owing to its lesser adhesion to the covering: the impurities are projected selectively towards the exterior, since they are heavier and coarser than the fibres. Going from the first cylinder to the last, the centrifugal and ventilating action increases greatly, and the fibres are progressively more free and in smaller flocks, but they are retained progressively more densely by the coverings.

In brief, the action of the rollers 5,25,45 with metal coverings which are increasingly dense, and which counter-rotate at increasingly great peripheral speeds, assists in equalising the density of the fibrous mass, since the transfer of the flock from one operating surface to the next gives rise to an intensity of opening and cleaning of the flock, which is the same for the entire volume of fibres supplied, and increases progressively along the path between the cylinders. The units for opening and separation give rise to separation of the impurities, which, as they are detached from the surface of the layer of flock previously opened by centrifugal effect, are evacuated by the aforementioned mechanical elements, according to their reciprocal adjustments of distance and angles. Each suction mouth which is associated with the blades is connected to a centralised suction system, which keeps them constantly free and efficient.

The effect required from the separator blades (6,7 of the first cylinder, and 26,46 of the other cylinders), is in fact to intercept the material which is released substantially by centrifugal force from the layer of fibres on the covering, and to deflect it towards the suction mouths. This action by the blades requires some description in greater depth, with reference to the enlarged detail in FIG. 1A, which illustrates by way of example the first blade 6 applied to the first cylinder 5, again with reference to the known art.

The surface of the cylinder 5 is provided with a covering consisting of needles 18, the spikes of which move along a surface 19 indicated with a dot and dash line. The cylinder 5 rotates in an anti-clockwise direction, according to the arrow, and generates a significant ventilating action in the same direction. The blade 6 is presented to the fibrous material which is retained by the needles 18. The blade comprises an outer doffing surface 60, which receives the flow of air and material which escapes from the needle covering 18, a sharp edge 61, and an oblique inner surface 62, which is connected by means of the obtuse edge 63 to the inner surface 64, which is parallel to the surface 60. The separator blade 6 is mounted on its support 12 relative to the cylinder 5, with its acute edge 61 at the minimum distance from the surface 19 which is travelled by the spikes of the needles 18, and which in general is approximately 1 mm, and with its oblique surface 62 disposed at an angle $\alpha$ relative to the tangent to the surface 19, with the vertex disposed upstream from the motion of the cylinder. The oblique inner surface 62 is thus spaced from the surface 19, in the direction of the anti-clockwise motion of the cylinder 5, and does not make any significant contribution to the processing.

This shape and arrangement of the separator blade is effective in separating and capturing the dirt from the fibre flock, but it has the disadvantage that it also captures and separates a substantial quantity of fibres which are fit for spinning. A significant quantity of these fibres which are fit for spinning is engaged at one end by the coverings, irrespective of whether the latter consist of needles, spikes or sawteeth, but at the other end, they can project with a free section towards the exterior, by means of the centrifuging effect and the ventilating effect. They can thus come into contact with the sharp edge 61 of the blade. For some of the fibres, the action of engagement by the covering prevails, i.e. the fibres are folded and continue in the anti-clockwise rotation. For the remaining part of the fibres, the action of the blade 6 prevails, i.e. the fibre rises to the doffing surface 60, and is separated from the covering of the cylinder 5. In general, the waste material consists of dirt, short fibres and fibres which are fit for spinning, with an undesirable content of fibres which are long and fit for spinning, which can even exceed 50% of the total. This part constitutes a processing loss which must be restricted as much as possible, whilst releasing the content of dirt and short fibres from the fibres.

The present invention relates more specifically to a newly designed shape and arrangement of the separator blade, in order to obtain highly efficient and high-quality work of opening and cleaning of the fibrous flock material, whilst restricting the losses of long fibres.

In order to illustrate more clearly the characteristics and advantages of the present invention, it is described by way of non-limiting example, with reference to a typical embodiment contained in FIGS. 2, 2A and 3, of the first fixed support, indicated as 12 in FIG. 1, which supports the separator blade according to the present invention in its characteristic shape and arrangement. It can also be applied, and relate to, the remaining separator units which are disposed along the path of the flock fibres, on the surfaces of the cylinders 25 and 45.

According to the embodiment in FIG. 2, the support 70, which corresponds to the support 12 in FIG. 1, consists of a fixed structure in the form of a bar with a trapezoidal cross-section, which extends in an axial direction along the generatrix of the cylinder 5. On its left-hand surface, in a manner which is known, and the means for securing and adjustment of which are not shown in the figure, the structure 70 supports the blade 71 according to the present invention, which is also shown in the enlarged detail in FIG. 2A.

The blade 71 has a triangular cutting edge, i.e. it consists of a blade with two parallel surfaces 72,73, which are connected by a cutting edge which comprises, in order, an outer doffing surface 74, which receives the flow of air and material which escapes from the needle covering 18, an acute edge 75, and an inner guide surface 76, which is connected by means of the obtuse edge 77 to the inner surface 73, which is parallel to the surface 72. The separator blade 71 works with the two surfaces 74,76, and is mounted on its support 70, relative to the cylinder 5, with its obtuse edge 77 at the minimum distance from the surface 19, which is travelled by the spikes of the covering 18, of an extent which is similar to that of the sharp edge 61 in FIG. 1A, and in general is approximately 1 mm, whereas its acute edge 75 is further distant. Its inner surface 76 is thus disposed according to a small angle $\alpha'$ relative to the tangent to the surface 19, and with the vertex disposed downstream from the motion of the cylinder. The value of this angle $\alpha'$ is between 1° and 25°, and preferably between 3° and 10°. The inner surface 76 thus approaches the surface 19 in the direction of the anti-clockwise motion of the cylinder 5, and is useful in the processing, as described hereinafter.

This shape and arrangement of the separator blade 71 according to the invention is effective in separating and capturing the dirt from the fibre flock, since its outer doffing surface 74 deflects efficiently the material projected from the layer of fibre which is retained on the needle covering 18, but, relative to the fibres which can project towards the exterior by means of the centrifuging effect and the ventilating effect, its inner surface 76 behaves differently from that of the blade in FIG. 1A. The fibres which come into contact with the sharp edge 75 of the cutter are in fact guided, by the inner surface 76 itself, in being folded and returned to engagement with the needle covering 18. Compared with the configuration illustrated in FIG. 1A, in the case of most of the fibres, the action of engagement by the covering prevails, whereas there is a smaller residual part of fibres fit for spinning, for which the action of separation by the blade 71 prevails. The separator blades according to the present invention are mounted on their support, and the distance relative to the work surface 19 of the covering is adjusted according to the requirements of the carding process.

A preferred embodiment of the invention is illustrated with reference to FIGS. 2 and 3. After having met the separator blade 71, the fibres are carried by the needle covering 18, by means of anti-clockwise rotation, to the carding plate 10, where they are disentangled, stretched, and equalised into smaller and more regular flocks, however giving rise to the phenomenon previously described, i.e. that some of the fibres, the ends of which project beyond the covering, can be captured by the separator blades, together with the waste, the dirt, and the short fibres. For this purpose, according to a preferred embodiment of the present invention, of which an example is illustrated in the enlarged detail in FIG. 3, the mobile deflector 80, which is disposed at the end of the opening and separation element, which is supported by the support 70, and downstream from the fixed carding element 10, is produced according to a specific shape and arrangement.

In the known art, this mobile deflector carries out the function both of modulating the size of the angular aperture available for the centrifugal effect on the waste to be separated at the blade which follows, and of modulating the radial distance, in order to create a more or less contracted vein area, for the flow of air created by rotation of the covered cylinder 5, by ventilating effect. According to the embodiment illustrated in FIG. 3, the mobile deflector 80 has a tapered shape, with its inner surface, which is presented to the surface 19 of the spikes of the needles 18 of the covering, consisting of two substantially flat surfaces, i.e. a shorter surface 81 and a longer surface 82, which are connected by means of an obtuse edge 83.

The deflector 80 is adjustable angularly, in a known manner, between a position A of maximum approach to the surface 19, which is illustrated by a solid line, and a position B of maximum displacement from the surface 19, which is illustrated by a broken line. In the position A of maximum approach, the free end of the fibres, which are supported by the covering 18, meet firstly the surface 81, which thrusts them radially towards the interior, then the surface 82, which accompanies them for the longer section, in order to return them into the covering. When the fibres thus deflected to the interior meet the next blade 7, which is shown with the same shape and arrangement as the blade in FIG. 2A, the effect of removal by the blade on the fibres fit for spinning is reduced to a minimum, i.e. in the position A, there is thus maximal continuation of the reduction of the quantity and length of the fibres which project from the needle covering 18, and of loss of these fibres as waste. A contribution to this effect is also made by the contracted vein for the ventilating air, in the position in which the end edge 84 is as close as possible to the covering, i.e. the increased speed of the air thrusts the ends of the fibres towards the interior of the covering.

The distances and the regulations of this position are similar to those indicated for the surface 76 of the blade 71 in FIG. 2A. In the position A, the deflector 80 is taken with its end edge 84 to the minimum distance from the surface 19, which is travelled by the spikes of the needles 18, which is of an extent similar to that of the sharp edge 61 in FIG. 1A, and in general is approximately 1 mm, whereas its sharp edge 83 is further distant. Its flat inner surface 82 is thus disposed according to a small angle $\beta$, relative to the tangent to the surface 19, which angle has a value similar to the angle $\alpha'$ in FIG. 2A, and with the vertex disposed downstream from the motion of the cylinder 5. Similarly, in the position of maximum approach, this angle $\beta$ is between 1° and 25°, and preferably between 3° and 10°.

On the other hand in the position B of maximum displacement, the maximum effect of rejection of the waste is continued. In the position B, the deflector 80 is taken with its end edge 84 to the maximum distance from the surface 19 travelled by the spikes of the needles 18, according to a value of between 15 and 25 mm. Its flat inner surface 82 is thus disposed relative to the tangent to the surface 19, according to an angle, the vertex of which can, on the other hand, be disposed upstream from the motion of the cylinder 5. According to this configuration, there is continuation of the maximum centrifugal effect, the minimum contraction of the vein for the flow of the ventilating air, and the maximum release of the waste, with the blade 7 of the separator unit which follows receiving the fibres treated by the preceding fixed carding segment 10. The intermediate positions between A and B represent solutions of compromise between the two requirements.

It can be noted that the carding element according to the invention, illustrated in the embodiment in FIGS. 2 and 3, has operating characteristics which are very advantageous, and provide substantial benefits. It has the characteristic that it can be adapted to the variation of quality of the fibres processed, to the requirements of efficiency of removal of the dirt and short fibres, and to the need to restrict the losses of long-fibre material which is fit for spinning.

The efficiency of the separator unit according to the invention has been tested experimentally, by using on a single batch of cotton, the configurations of the blade 6 in FIG. 1A, and of the blade 71 in FIG. 2A, with the same regulations of the distance and of the other parameters, in the first processing element of the cylinder 5.

Using 28 mm Russian cotton, 4.9 micronaire, with a content of dirt and dust variable between 1.17 and 1.38 weight %, and short fibres of between 9.8 and 14.4 weight %, and for the same percentage efficiency of removal of the dirt and dust at the first mouth 8, the content of long fibres fit for spinning in the material collected in the said mouth, in the case of the technical solution according to FIG. 2A, was substantially less than the solution in FIG. 1A, with values which varied between 16 and 22% less. The material collected by the first mouth 8, by means of the first separator unit with the blade according to FIG. 1A, had an average content of fibres fit for spinning of approximately 50%, whereas, when the separator unit according to FIG. 2A was used, this average content was approximately 40%.

What is claimed is:

1. Unit for opening and separation of the impurities in a machine for opening or carding of flock textile material, the machine including a rotating cylinder having a plurality of spikes, and a fixed support element which supports separator blades which are associated with fixed carding elements for equalisation of the flock and removal of the impurities, wherein at least one of the separator blades comprises;

an outer doffing surface, and an inner guide surface which connects to said outer doffing surface via an acute edge and which is disposed at an angle ($\alpha$) between 1° and 25° relative to a tangent to the portion of the surface travelled by the spikes of the covering facing the inner guide surface, and with a vertex of the angle disposed downstream in the direction of motion of the cylinder.

2. Unit for opening and separation of the impurities according to claim 1, wherein the angle ($\alpha$) is between 3° and 10°.

3. Unit for opening and separation of the impurities according to claim 1, wherein the inner guide surface connects to an obtuse edge at an end of the inner guide surface opposite the acute edge, and wherein the obtuse edge is located at a minimum distance position of the blade from the surface travelled by the spikes.

4. Unit for opening and separation of the impurities according to claim 1, further comprising a mobile deflector which is positioned on the support element upstream of the separator blade, wherein the deflector has a tapered shape, and wherein the inner surface of the deflector which is presented to the spikes consists of two substantially flat surfaces which are connected at an obtuse edge.

5. Unit for opening and separation of the impurities according to claim 4, wherein the deflector is adjustable angularly between a position (A) of maximum approach to the surface, and a position (B) of maximum displacement from the surface, and wherein in the position (A) of maximum approach, its flat inner surface is disposed according to an angle (β) between 1° and 25° relative to the tangent to the surface, with the vertex disposed downstream in the direction of the motion of the cylinder.

6. Unit for opening and separation of the impurities according to claim 5, wherein in the position of maximum approach, the angle (β) is between 3° and 10°.

* * * * *